United States Patent [19]

Lee

[11] Patent Number: 4,592,551

[45] Date of Patent: Jun. 3, 1986

[54] BOWLING BALL

[75] Inventor: Andrew J. Lee, Hopkinsville, Ky.

[73] Assignee: Ebonite International, Inc., Hopkinsville, Ky.

[21] Appl. No.: 714,214

[22] Filed: Mar. 21, 1985

[51] Int. Cl.[4] ..... A63B 37/10

[52] U.S. Cl. ..... 273/63 E; 273/63 C

[58] Field of Search ..... 273/63 E, 63 R, 63 A, 273/63 B, 63 C, 63 D, 63 F, 63 G, 128 R, 128 A

[56] References Cited

U.S. PATENT DOCUMENTS

| | | | |
|---|---|---|---|
| 863,126 | 8/1907 | Wilson | 273/63 E |
| 2,291,738 | 8/1942 | Luth et al. | 273/63 E |
| 2,414,672 | 1/1947 | Sauer | 273/63 A |
| 3,591,177 | 7/1971 | Skuse | 273/63 E |
| 3,865,369 | 2/1975 | Randolph | 273/63 E |
| 4,131,277 | 12/1978 | Randolph | 273/63 D |
| 4,264,071 | 4/1981 | Randolph | 273/63 E |
| 4,268,034 | 5/1981 | MacDonald | 273/63 C |
| 4,461,478 | 7/1984 | Lee et al. | 273/63 R |

*Primary Examiner*—George J. Marlo

*Attorney, Agent, or Firm*—Kinzer, Plyer, Dorn & McEachran

[57] ABSTRACT

An integral, solid bowling ball, devoid of any significant hollow portion, with inherent hooking characteristics has an elongated rod-like core that is symmetrical about the finger hole axis of the ball. The core is much denser than the encompassing body of the ball, preferably by a factor exceeding 2:1, has an axial length exceeding six-tenths of the ball diameter, and has an average diameter of about one-third of the ball diameter, with the core providing about one-fourth of the total ball weight. A frusto-conical core shape is preferred.

14 Claims, 5 Drawing Figures

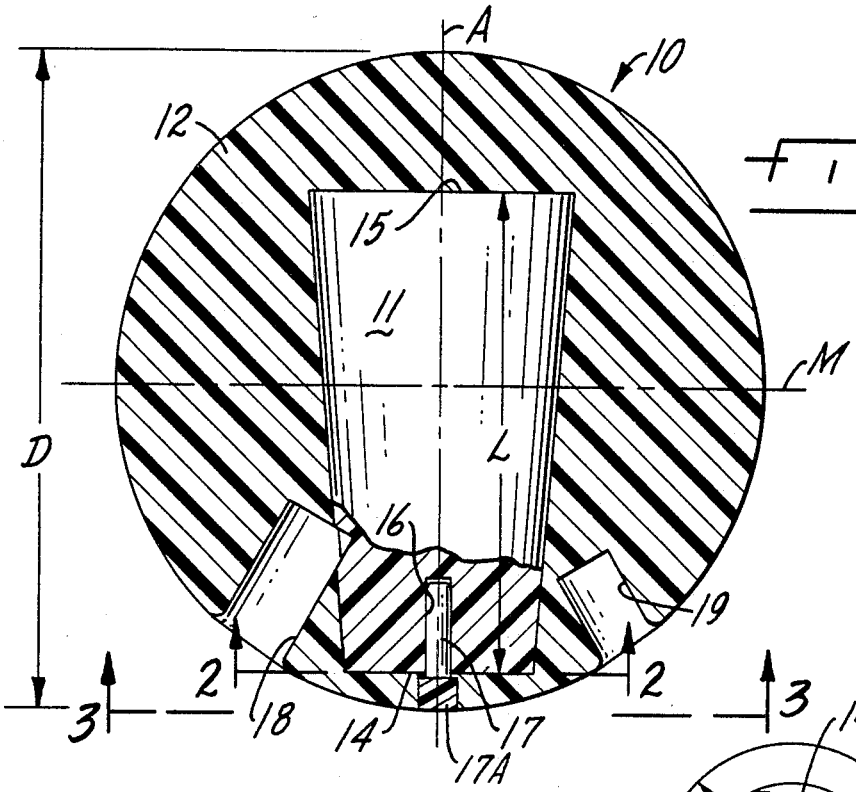
Fig. 1.
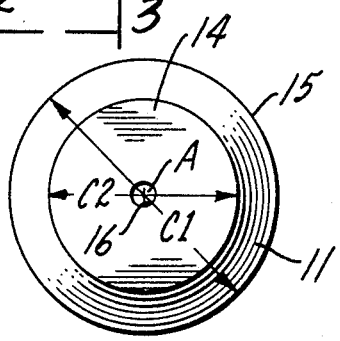
Fig. 2.
Fig. 5.
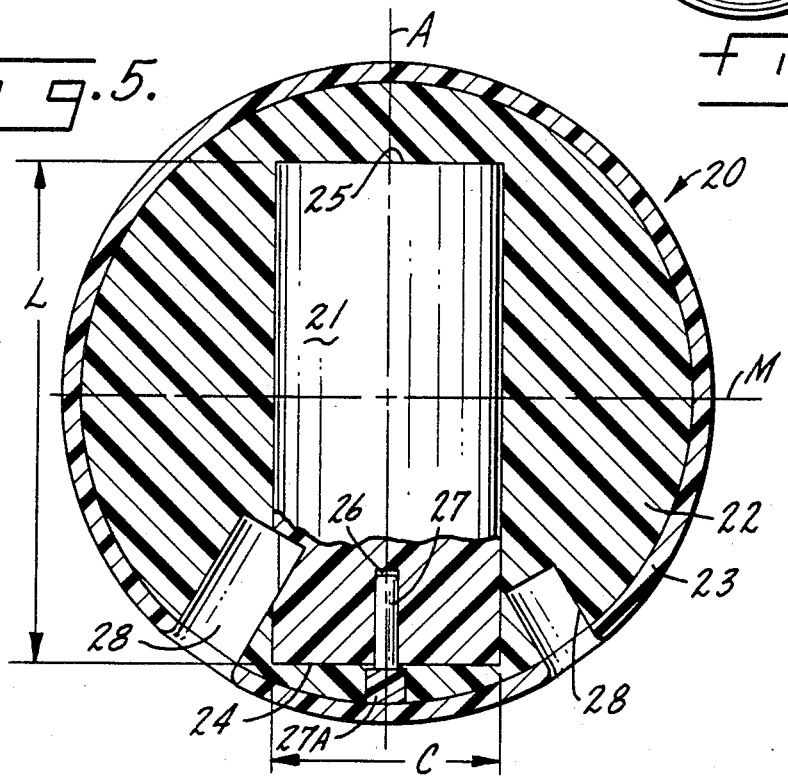

BOWLING BALL

BACKGROUND OF THE INVENTION

A tenpin bowling ball may be of uniform, homogenous construction throughout, formed of hard rubber or of a variety of synthetic resins. More frequently, modern bowling balls are manufactured in a two-piece integrated construction comprising a spherical core with its exterior surface covered by a shell intended to afford optimal friction characteristics for the ball. In these balls, the overall weight of the ball is adjusted by varying the density and amount of fillers used in the rubber or resin of the core. An excellent bowling ball construction of this particular kind is described and claimed in Lee et al U.S. Pat. No. 4,461,478 issued July 24, 1984.

In a tenpin bowling ball, two or more frequently three finger holes are drilled into the ball to enable the bowler to lift and roll the ball. These finger holes result in an asymmetrical reduction in weight of the ball. To compensate for the resulting imbalance of the bowling ball, a variety of different expedients have been proposed. For example, Sauer U.S. Pat. No. 2,414,672 discloses an arrangement in which individual metal thimbles are mounted in the fingerholes; the thimbles include weights that compensate for the ball material removed from the fingerholes. Another previously known arrangement intended to compensate for the fingerhole weight imbalance is presented in Luth et al U.S. Pat. No. 2,291,738. The ball shown in the Luth et al patent incorporates an asymmetrical core, formed of two materials of quite different densities, with the heavier core material concentrated in the region around the fingerholes.

Another proposal for top-weighting of a bowling ball core to offset the loss of weight resulting from the drilling of fingerholes is presented in Randolph U.S. Pat. No. 3,865,369. This construction utilizes an asymmetreical core that is heavier or lighter than the body of the ball and is located closely adjacent to but entirely on one side of the mid-plane of the ball, the side where the fingerholes will be drilled. In one version the core constitutes a segment of a sphere; in others, it is of annular configuration. The spherical segment asymmetrical core is also disclosed in another Randolph U.S. Pat. No. 4,131,277. In the latter, there is also an illustration of a bowling ball having a bullet-shaped core.

These and most other prior art expedients are intended to compensate for the asymmetrical weight loss in a bowling ball that is occasioned by the drilling of one or more fingerholes into the ball. The intent is to afford rolling characteristics that most closely simulate those that would be obtained by a ball having a truly uniform weight distribution. For any such ball, of course, the "hooking" characteristic of the ball as it rolls down a lane, which is most desirable in achieving high scores, depends upon the frictional characteristics of the ball surface and the lane, the rotation imparted to the ball by the bowler, and other like factors. Even in those balls that include asymmetrical cores, such as those disclosed in the Luth et al and Randolph patents, the weight distribution within the ball does not contribute materially to an improvement in the hooking characteristic.

Another bowling ball construction, disclosed in MacDonald U.S. Pat. No. 4,268,034, includes two separate core members. One is a light weight core member aligned with a plane through the fingerhole axis of the ball. The other is an elongated top weight eccentrically disposed with respect to the finger holes. This arrangement is said to facilitate curving or hooking of the ball. An even more complex construction, employing a movable weight mounted on a lead screw extending into the interior of a blind hole in a bowling ball, is described in Skuse U.S. Pat. No. 3,591,177.

SUMMARY OF THE INVENTION

It is a principal object of the present invention, therefore, to provide a new and improved bowling ball incorporating a simple, single core which provides a built-in inherent hooking characteristic while conforming to the requirements of bowling organizations, particularly the American Bowling Congress.

Another object of the invention is to provide a new and improved bowling ball construction that inherently and automatically results in a change in the effective axis of rotation of a bowling ball, as it moves down a lane, to afford a consistent hooking action each time the ball is used, employing a simple and inexpensive construction.

Accordingly, the invention relates to an integral, solid bowling ball of the kind comprising a core totally encompassed by and integrally bonded into a spherical bowling ball body of diameter D. The core is of elongated rod-like configuration, symmetrical about a core axis, the core axis being aligned with and corresponding to a predetermined diametrical axis of the bowling ball body. The core has a density at least 1.6 times the average density of the bowling ball body and has an axial length L of at least 0.6D and an average diameter in cross-section of at least 0.2D.

BRIEF DESCRIPTION OF THE DRAWINGS

FIG. 1 is a diametrical cross-section view of a bowling ball constructed in accordance with a preferred embodiment of the invention;

FIG. 2 is an end view of the core of the bowling ball of FIG. 1, taken approximately as indicated by line 2—2 in FIG. 1.

FIG. 5 is a diametrical cross-section view of a bowling ball constructed in accordance with another embodiment of the invention.

DESCRIPTION OF THE PREFERRED EMBODIMENTS

Figure 3:
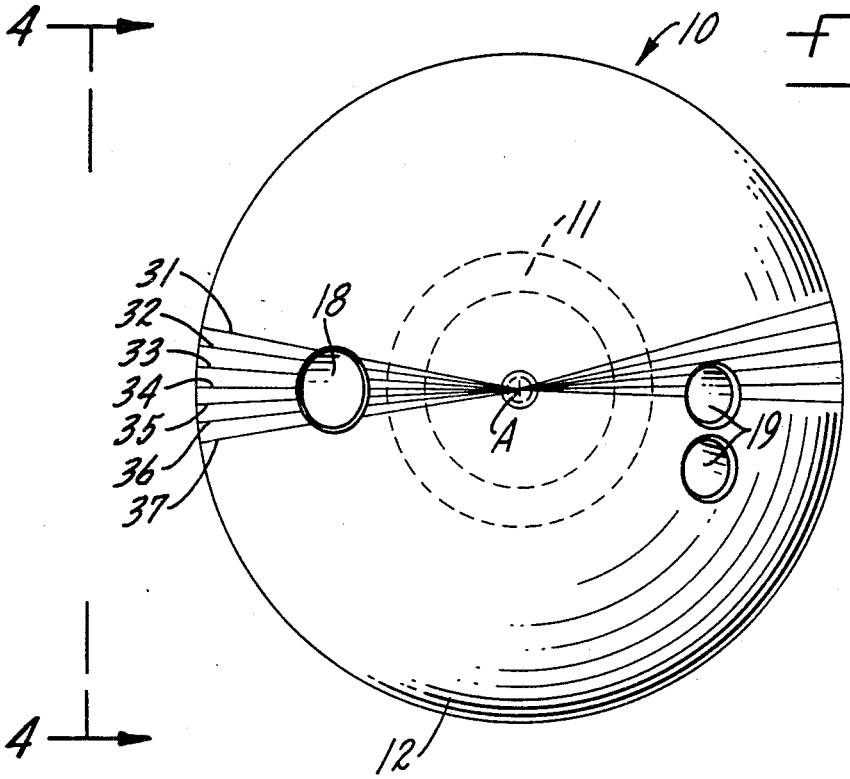
FIG. 3 is a view, taken approximately as indicated by line 3—3 in FIG. 1, of the bowling ball of FIG. 1 marked to show changes in the rotational axis as the ball rolls down a lane.

FIG. 1 illustrates a bowling ball 10 constructed in accordance with a preferred embodiment of the invention. Ball 10 includes a core 11 encompassed by and integrally bonded into a spherical bowling ball body 12. The body 12 of ball 10, in finished form, has a diameter D. For tenpins, the most prevalent form of bowling in the United States, the diameter D must be in the range of 8.5 to 8.595 inches, affording a ball circumference of approximately twenty-seven inches. For most tournament bowling, the weight of ball 10 is sixteen pounds, but lower weight balls are permitted.

Core 11, generally speaking, is of elongated rod-like configuration, symmetrical about an axis A. In ball 10, the core axis A is aligned with and corresponds to a predetermined diametrical axis of the spherical bowling ball body 12, referred to herein as the fingerhole axis. In the preferred embodiment illustrated in FIG. 1, core 11 is of slightly tapered or frusto-conical configuration, with one end surface 15 larger than the other end surface 14. For example, the larger end 15 of core 11 may have a maximum dimension or diameter C1 of 3.5 inches whereas the other end 14 of the core has a diameter C2 of 2.5 inches. That is, core 11 has an aspect ratio of approximately 1.4:1 and the average core diameter is three inches.

Although core 11 is asymmetrical relative to the encompassing spherical body 12 of ball 10, the weight of the core is preferably distributed approximately symmetrically relative to the mid-plane M of the ball. This is accomplished by mounting core 11 within body 12 so that core surface 14 is closer to the outer surface of body 12 than core surface 15. For a core 11 having a length L of 6.25 inches, the desired equalized weight distribution relative to mid-plane M is effected by locating core 11 within body 12 so that surface 15 is spaced 2.5 inches from the mid-plane leaving surface 14 spaced 3.75 inches from the mid-plane. For a core of the stated dimensions, this results in virtually exact equalization of the core weight on either side of mid-plane M.

To obtain the desired hooking characteristic of the present invention, core 11 has an appreciably higher density than ball body 12. In a sixteen pound ball, for example, a preferred weight for core 11 is approximately four pounds, with the balance (twelve pounds) of the total ball weight afforded by body 12. That is, the ratio of the weight of the bowling ball body 12 to the weight of core 11, in one preferred construction, is approximatley 3:1. This ratio is subject to some variation. To assure an effective hooking characteristic as an inherent property of the completed ball, the ratio of the weight of the ball body to the weight of the core should be at least about 2.5:1. To avoid excessive eccentricity in the rolling characteristics of the ball, that ratio should not be appreciably greater than 4:1.

For a ball having a core and body of the dimensions and weight stated above, a preferred density for the material employed for core 11 is approximately 0.09 pounds per cubic inch, inasmuch as core 11 has a volume of about 43.5 cubic inches. The volume of body 12 is about 280 cubic inches and should have a density of approximately 0.043 pounds per cubic inch. That is, the ratio of the core density to the density of the bowling ball body 12 is approximately 2.1:1. Again, this ratio is subject to some variation. For the core to have an appreciable effect upon the operational characteristics of bowling ball 10, and particularly to assure an effective hooking characteristic, this ratio should be at least about 1.6:1. As a practical matter also, it is not likely to exceed 2.4:1.

A core 11 having a relatively short overall length L, compared to the ball diameter D, is not satisfactory with respect to achievement of the objectives of the present invention. With the stated dimensions, core length L is approximately 0.735D. To be effective in obtaining a built-in hooking characteristic, the core length L should be 0.6D or more. For shorter cores, an inherent hooking characteristic is not likely to be obtained. Of course, the upper limit on length L is that determined by the overall ball diameter D, since the core must be covered by an appreciable portion of ball body 12, at least to a depth of about 0.25 inch.

In order to achieve an inherent hooking characteristic in bowling ball 10, there are also certain minimum requirements for the diameter of core 11. Thus, a thin, pencil-like core will not do the job, particularly because it cannot include sufficient weight without resort to a metal core that would not conform to standards applicable to tournament balls. In general, to get the necessary weight into core 11, using permissible materials, the average cross-sectional diameter of core 11 should be in excess of 0.2D. For the preferred dimensions given above, the average of dimensions C1 and C2 is approximately 0.35D.

Bowling ball 10 can be fabricated from hard rubber with appropriate fillers to obtain the necessary higher density for core 11 as compared with body 12. The preferred construction for ball 10, however, employs filled synthetic resins. Polyester resins are preferred for both the core and the body of the ball, but other resins such as polyurethane and epoxy resins may be used. The fillers employed in core 11 should be dense, heavy materials; barytes are preferred. Virtually any conventional filler material can be utilized for body 12. The inherent hooking characteristic of ball 10 is not derived from the use of specific materials; it is the shape and weight distribution of core 11 that provide the improvement of the invention.

The manufacture of ball 10 can be carried out by conventional procedures. Core 11 is first molded by known methods, and an axial hole 16 is drilled in the small end 14 of the core. Core 11 is then mounted upon a support pin used to support the core in a spherical ball mold. The ball body 12 is then molded around the core. After removal from the mold, the pin hole 16 is filled with a wooden dowel 17 and a resin plug 17A. It is usually necessary to finish the exterior surface of body 12, again a conventional procedure. Pin 17 may be left in place, as shown. Suitable fingerholes are subsequently drilled in ball 10, as indicated by the dash outline 18 for a thumb hole and dash outline 19 representing one or two fingerholes.

Figure 4:
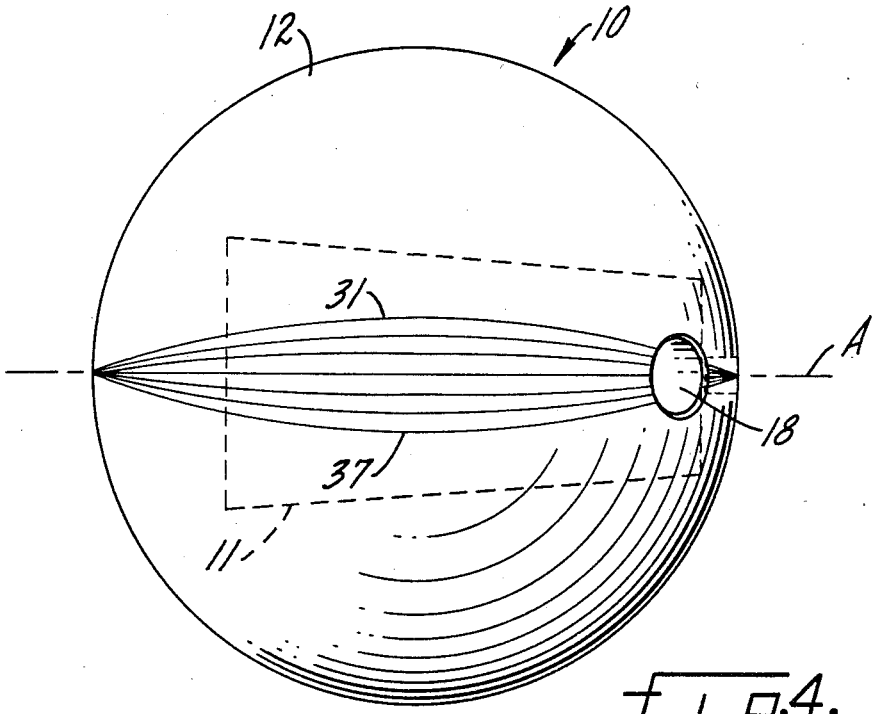
FIG. 4 is a view taken approximately as indicated by line 4—4 in FIG. 3.

FIGS. 3 and 4 illustrate the operating characteristics of ball 10 as it rolls down a bowling lane. In these figures ball 10 is shown as marked with a series of lines 31–37 indicating successive lines of contact between the ball and the lane, obtained by observation of deposits of oil from the lane onto the ball.

As can be seen from FIGS. 3 and 4, as ball 10 rolls down a bowling lane the rotation of the ball brings progressively displaced segments of the ball surface into contact with the lane. This progressive variation in the ball track occurs independently of wrist action or the like on the part of the bowler; it is inherent from the construction of ball 10. Of course, the track variation shown in FIGS. 3 and 4 can be exaggerated by action of the bowler. However, the bowler cannot effectively eliminate this variable track effect and the hooking action it represents.

FIG. 5 illustrates a bowling ball 20 constructed in accordance with another embodiment of the invention. Ball 20 comprises a rod-like core 21 totally encompassed by and integrally bonded into a spherical bowling ball body 22, which in this instance is covered with an external shell or veneer 23. Core 21 is essentially uniform in diameter throughout its length and the core axis A is coincident with a predetermined diametrical axis of the bowling ball body 22, 23. As before, the finished ball structure includes a pin 27 and plug 27A filling the pin hole 26 left by the pin used to support core 21 in a mold for the formation of ball body 22. The outer shell 23 may be formed of a material having preferred friction characteristics, such as the materials described in the aforementioned patent and patent application of Lee et al.

For ball 20 the same basic considerations apply as for ball 10. The ratio of the core density to the average density of the bowling ball body 22 and shell 23, should be in the range of about 1.6:1 to 2.4:1. The ratio of the weight of the body of ball 20 to the weight of its core should be in the range of about 2.5:1 to 4:1. The diameter C of core 21, as illustrated, is three inches; it should be at least one-fifth of the diameter of ball 20 in order to obtain adequate weight in the core. The length L of core 21, as shown, is 6.5 inches; it should be at least 0.6D.

In ball 20, the weight of core 21 is not equally distributed on opposite sides of the mid-plane M, as in the previous embodiment. Instead, core 21 is aligned within ball 20 so that more than one-half of the core weight is located on one side of the mid-plane M, the side where the fingerholes 28 are ultimately drilled. That is, the one end 25 of core 21 is three inches from mid-plane M, whereas the other end 24 of the core is 3.5 inches from the midplane. The differential in weight distribution on opposite sides of plane M is about 54% to 46%. As a consequence, core 21 affords a top weight for ball 20. On the other hand, the unequal distribution of the weight of core 21 relative to mid-plane M, in ball 20, is not particularly desirable; the conical construction of core 11, FIG. 1, is much preferred because it achieves superior operating characteristics in a ball with essentially equalized weight distribution relative both to mid-plane M and to any plane through ball 10 that includes axis A.

Balls 10 and 20 each incorporate a simple, single, inexpensive core. Conventional materials and known manufacturing techniques are employed, keeping manufacturing expense to a minimum. Balls made in accordance with the invention meet all standards applicable to tournament bowling balls, yet afford effective, inherent hooking characteristics.

I claim:

1. An integral, solid bowling ball of the kind devoid of any significant hollow portion and comprising a core totally encompassed by and integrally bonded into a spherical bowling ball body of diameter D, in which:

the core is of elongated rod-like configuration, symmetrical about a core axis, the core axis being aligned with and corresponding to a predetermined diametrical axis of the bowling ball body;

the core has a density at least 1.6 times the average density of the bowling ball body; and the core has an axial length L of at least 0.6D and an average diameter in cross-section of at least 0.2D.

2. A bowling ball according to claim 1 in which the ratio of the core density to the average density of the bowling ball body is in the range of 1.6:1 to 2.4:1.

3. A bowling ball according to claim 2 in which the ratio of the weight of the bowling ball body to the weight of the core is in the range of 2.5:1 to 4:1.

4. A bowling ball according to claim 1 in which the core is of frusto-conical configuration, with an aspect ratio of about 1.4:1.

5. A bowling ball according to claim 4 in which the ratio of the core density to the average density of the bowling ball body is in the range of 1.6:1 to 2.4:1.

6. A bowling ball according to claim 5 in which the ratio of the weight of the bowling ball body to the weight of the core is in the range of 2.5:1 to 4:1.

7. A bowling ball according to claim 6 in which the average core diameter is approximately 0.35D.

8. A bowling ball according to claim 1 in which the weight of the core is distributed approximately symmetrically relative to the midplane of the ball.

9. A bowling ball accoring to claim 8 in which the ratio of the core density to the average density of the bowling ball body is in the range of 1.6:1 to 2.4:1.

10. A bowling ball according to claim 9 in which the ratio of the weight of the bowling ball body to the weight of the core is in the range of 2.5:1 to 4:1.

11. A bowling ball according to claim 8 in which the core is of frusto-conical configuration, with an aspect ratio of about 1.4:1.

12. A bowling ball according to claim 11 in which the ratio of the core density to the average density of the bowling ball body is in the range of 1.1:1 to 2.4:1.

13. A bowling ball according to claim 12 in which the ratio of the weight of the bowling ball body to the weight of the core is in the range of 2.5:1 to 4:1.

14. A bowling ball according to claim 12 in which the average core diameter is approximately 0.35D.

* * * * *